US008857393B2

(12) United States Patent
Brenner et al.

(10) Patent No.: US 8,857,393 B2
(45) Date of Patent: Oct. 14, 2014

(54) CAMSHAFT ADJUSTER

(71) Applicant: Schaeffler Technologies AG & Co. KG, Herzogenaurach (DE)

(72) Inventors: Holger Brenner, Obermichelbach (DE); Stefan Schelter, Dottenheim (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/775,351

(22) Filed: Feb. 25, 2013

(65) Prior Publication Data

US 2013/0233264 A1 Sep. 12, 2013

(30) Foreign Application Priority Data

Mar. 8, 2012 (DE) ..... 10 2012 203635

(51) Int. Cl.
*F01L 1/34* (2006.01)
*F01L 1/344* (2006.01)

(52) U.S. Cl.
CPC ..... *F01L 1/344* (2013.01); *F01L 2001/34459* (2013.01); *F01L 2001/34466* (2013.01); *F01L 1/3442* (2013.01)
USPC ..... 123/90.17; 123/90.15

(58) Field of Classification Search
CPC ..... F01L 1/344; F01L 1/3442; F01L 2001/34459; F01L 2001/34466; F01L 2001/34469; F01L 2001/34463
USPC ..... 123/90.15, 90.17, 90.31
See application file for complete search history.

(56) References Cited

U.S. PATENT DOCUMENTS 6,443,112 B1 9/2002 Kinugawa
2005/0226736 A1 * 10/2005 Lancefield et al. ..... 417/213

* cited by examiner

*Primary Examiner* — Zelalem Eshete
(74) *Attorney, Agent, or Firm* — Volpe and Koenig, P.C.

(57) ABSTRACT

A camshaft adjuster (1) is provided with a drive element (2) and an output element (3), including a locking mechanism (5) which is arranged in a locking bore (6) and has precisely two locking pistons (8, 9) and a locking spring (7), the locking bore (6) is formed in the drive element (2) or in the output element (3) and the respective other element (2, 3) which does not have the locking bore (6) includes the locking receivers (10, 11) associated with the locking pistons (8, 9).

9 Claims, 4 Drawing Sheets

CAMSHAFT ADJUSTER

INCORPORATION BY REFERENCE

The following documents are incorporated herein by reference as if fully set forth: German Patent Application No.: DE 102012203635.0, filed Mar. 8, 2012.

FIELD OF THE INVENTION

The invention concerns a camshaft adjuster.

BACKGROUND

Camshaft adjusters are used in combustion engines to vary the timing of the combustion chamber valves in order to be able to structure variably the phase relationship between a crankshaft and a camshaft in a defined angular range between a maximum advanced and a maximum retarded position. The adjustment of the cam timing to the actual load and rotation speed reduces the fuel consumption and emissions. To this end camshaft adjusters are integrated in a drive train, via which a torque is transmitted from the crankshaft to the camshaft. This drive train can be formed for example as a belt, chain or gear drive system.

In a hydraulic camshaft adjuster, the output element and the drive element form one or more pairs of pressure chambers acting against each other, which can be pressurized with hydraulic fluid. The drive element and the output element are arranged coaxially. The filling and evacuation of individual pressure chambers generates a relative movement between the drive element and the output element. A spring acting rotationally between the drive element and the output element presses the drive element in one direction versus the output element in a desired direction. This desired direction can be the same as or opposite to the rotation direction.

One type of hydraulic camshaft adjuster is the vane adjuster. The vane adjuster has a stator, a rotor and a drive wheel with external toothing. The rotor as output element is usually formed connectable in a rotationally fixed manner with the camshaft. The drive element contains the stator and the drive wheel. The stator and the drive wheel are connected together rotationally fixed or alternatively are formed as one piece with each other. The rotor is arranged coaxial to the stator and inside the stator. The rotor and the stator, with their radially extending vanes, form oil chambers with opposing action which can be subjected to oil pressure and enable a relative rotation between the stator and the rotor. The vanes are either formed as one piece with the rotor or stator or are arranged as "push-fit vanes" in grooves of the rotor or stator provided for this. Furthermore vane adjusters have various sealing covers. The stator and the sealing covers are fastened together via several screw connections.

Another design of hydraulic camshaft adjuster is the axial piston adjuster. Here via oil pressure a slider element is displaced axially and via helical toothing generates a relative rotation between a drive element and an output element.

U.S. Pat. No. 6,443,112 B1 shows a camshaft adjuster with a locking mechanism, comprising a locking piston and a locking spring, which can fix the output element to the drive element in a middle position or in the maximum retarded position.

SUMMARY

The object of the invention is to provide a camshaft adjuster which has a particularly simple locking mechanism.

This object is achieved by a camshaft adjuster with one or more features of the invention.

A camshaft adjuster with a drive element and an output element, wherein the drive element is rotatable in relation to the output element within an angular range about the rotational axis of the camshaft adjuster, a locking mechanism is placed in a locking bore of the drive or output element, wherein the locking mechanism can assume a locked or an unlocked state in order to block or allow a rotation between the drive and output elements, according to the invention in order to achieve the object is characterized in that the locking mechanism has precisely two locking pistons, wherein at least one locking spring applies force simultaneously to both locking pistons, wherein a locking receiver is associated with each locking piston in order to fix an angular position between the drive and the output elements, and the locking receivers are arranged within the angular range and are formed in one and the same drive or output element respectively which does not comprise the locking bore.

Locking receivers are any form of recess e.g. grooves, blind bores, depressions, etc. In the sense of the invention the two locking receivers are formed as recesses so that an angular position is fixed i.e. also two partly circumferential grooves can be formed as locking receivers, wherein the ends of the two grooves together firmly define the angular position and no further rotation can take place between the drive element and the output element. Thus a locking receiver means at least one stop face oriented in the peripheral direction which together with a further stop face, together or alone, fixes an angular position when the locking mechanism is in the locked state.

The preferred area of application of the invention is in particular hydraulic camshaft adjusters in vane construction which comprise a drive element and an output element which each form several radially protruding vanes, wherein the vanes divide working chambers with opposing action and the working chambers can be pressurized with hydraulic fluid in order to achieve a relative rotation about the rotational axis of the camshaft adjuster between the drive element and the output element.

Also between the drive element and the output element can be provided a rotationally acting spring which presses the drive element relative to the output element in a desired direction. This desired direction can be the same as or opposite to the rotation direction.

The locking bore can be arranged in a vane of the hydraulic camshaft adjuster or in the region of the hub, in particular the hub of the output element. The locking bore is formed as a continuous axial bore in which is arranged the locking mechanism with the two locking pistons and a locking spring. The locking spring presses the two locking pistons apart or away from each other. If hydraulic fluid acts on the end of the respective locking piston facing away from the locking spring, said piston is moved against the locking spring force and lowered into the locking bore. Thus the locking mechanism transforms from the locked state into the unlocked state and allows the rotation between the drive element and output element within the angular range. If a locking piston is opposite the respective locking receiver, the locking piston locks into the locking receiver if no hydraulic fluid pressure is present on the end of the locking piston facing away from the locking spring. The locking mechanism transforms from the unlocked state to the locked state and fixes the drive element in relation to the output element in at least one angular position within the angular range.

The angular range between the drive and output elements is limited by two extreme positions which are formed by fixed and immovable stops. Typically the two extreme positions of a camshaft adjuster are the maximum "advanced" and "retarded" angular positions.

The invention means that very little construction space is required for the locking mechanism of the camshaft adjuster and simultaneously the components of the locking mechanism can be reduced. In particular in the camshaft adjuster which adjusts only one camshaft relative to the crankshaft, the reduction of costs and construction space is extremely advantageous.

In one embodiment of the invention both locking pistons with their associated locking receivers fix precisely one angular position. This angular position can coincide with one of the two extreme positions of the drive and output element or correspond to an intermediate position, ideally the middle position, between the two extreme positions. The two locking receivers for this are arranged aligned, preferably in the axial direction. Ideally all locking receivers are formed in the drive element.

In an advantageous embodiment, both locking pistons with their associated locking receivers fix precisely two angular positions. The one angular position can coincide with one of the two extreme positions of the drive and output element while the other angular position coincides with an intermediate position, ideally the middle position, between the two extreme positions. Alternatively both angular positions can be the extreme positions. For this the two locking receivers are not arranged aligned, so that two angular positions can be achieved. Ideally all locking receivers are formed in the drive element.

In a particularly preferred embodiment, for the first and second locking receivers, a third locking receiver is present which is spaced from the first or the second locking receiver in the circumferential direction and in which the first or the second locking piston can engage. Thus two or three angular positions can be fixed. Three angular positions can be fixed if all three locking receivers are spaced from each other in the circumferential direction and none aligns with another. If two of the three locking receivers align with each other, preferably in the axial direction, two angular positions can be fixed.

Two of the three angular positions can coincide with the two extreme positions of the drive and output element while the other angular position coincides with an intermediate position, ideally the middle position, between the two extreme positions. Alternatively one angular position can be the extreme position while the remaining two angular positions can be intermediate positions, wherein preferably one of the intermediate positions coincides with the middle position. Ideally all locking receivers are formed in the drive element.

In one embodiment of the invention the angular position corresponds to an intermediate position between two extreme positions of the drive and output elements. Preferably the intermediate position is the same as the middle position.

In a preferred embodiment the locking receivers are formed in the drive element and the locking bore with the locking mechanism is provided in the output element.

The drive element can be formed of several parts and thus comprises at least one side cover which covers the working chambers in an axial direction. The side cover can comprise all locking receivers or only one locking receiver. In the latter case the remaining locking receiver is formed either by an axial side wall formed as one piece with the drive element or by a further side cover which lies axially opposite the first side cover.

In a further embodiment of the invention both locking pistons have the same outer diameter which is provided for guidance in the locking bore. The outer diameter is formed constant over the entire length of the locking piston in order thus to achieve the maximum guide length of the locking piston with simultaneous reliable support in the locking bore when the locking mechanism is in the locked state. This also ensures an efficient seal between the end of the locking piston pressurized with hydraulic fluid, which engages in the locking receiver, and the end which is facing the opposing locking piston. This minimizes the accumulation of hydraulic fluid in the spring chamber in which the locking spring is arranged, which can inhibit the locking movement. To further increase the reliable locking movement, a purge opening is provided which opens firstly into the spring chamber and secondly into the environment. Surplus hydraulic fluid is discharged to the environment through the purge opening.

In one embodiment of the invention, in the locked state of the locking mechanism, the outer diameter of the locking piston is in engagement with a locking receiver of the respective locking piston. Advantageously the constant diameter prevents stress concentrations in the locked state of the locking mechanism, lowers production costs and reduces Hertzian stress of the contact in the peripheral direction between the locking piston and the locking receiver.

In an advantageous embodiment the locking pistons comprise a support for the locking spring such that this support is arranged axially inside the locking receiver when the locking mechanism is in the locked state. The locking piston is formed hollow cylindrical with one open and one closed face, and in the inside comprises the locking spring. The locking spring inside the locking piston is supported on the inside of the closed face. When the locking mechanism is in the locked state, this support is placed inside the locking receiver, whereby firstly the axial spring chamber is enlarged and secondly the locking pistons have a lower weight.

In a particularly preferred embodiment the locking pistons are formed identical. Advantageously in this way two locking pistons of the same design can be fitted in the locking mechanism, reducing costs and installation complexity.

The embodiment of the locking mechanism according to the invention achieves an extremely simple and compact construction which is reliable and economical. The arrangement of the locking receivers allows a wide variety of possibilities of the defined, fixed angular positions with simultaneous advantages in costs and construction space.

BRIEF DESCRIPTION OF THE DRAWINGS

Exemplary embodiments of the invention are shown in the figures. In the drawings.

DETAILED DESCRIPTION OF THE PREFERRED EMBODIMENTS

Figure 1A:
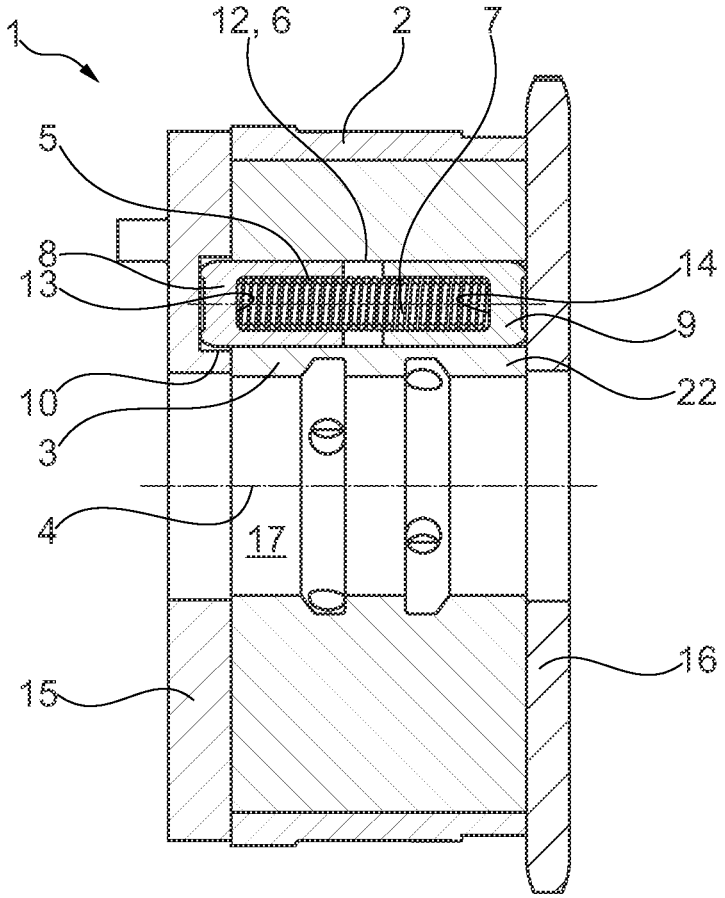
FIG. 1*a* shows a cross section through the locking bore of a camshaft adjuster of vane construction in a first angular position, wherein the first locking piston of the locking mechanism is locked in its locking receiver.

FIG. 1*a* shows a cross section through the locking bore 6 of a camshaft adjuster 1 in vane construction in a first angular position, wherein the first locking piston 8 of the locking mechanism 5 is locked in its locking receiver 10.

The camshaft adjuster 1 has a drive element 2, an output element 3 and two side covers 15, 16 which all have the same rotational axis 4 of the camshaft adjuster 1. The drive element 2 is connected rotationally fixed with both side covers 15, 16. The side cover 16 on its outer diameter has a toothing which can be brought into engagement with a traction element. The output element 3 is arranged rotationable relative to the drive element 2 within an angular range. As known from the prior art, output element 3 and drive element 2 have several vanes 20 and 21 which are arranged distributed around the circumference and divide working chambers A and B with mutually opposite action, which in turn can be filled with and drained of hydraulic fluid so that a relative rotation can take place of the output element 3 in relation to the drive element 2.

The output element 3 has a hub 22 from which four vanes 20 extend in the radial direction. In the region of these vanes 22 is arranged a locking bore 6 which has a locking mechanism 5. Through the hub 22 itself extends a central opening 17 via which the camshaft adjuster 1 can be connected with a camshaft not shown e.g. via a screw connection. The locking mechanism 5 is formed of two locking pistons 8 and 9 and a locking spring 7. The locking bore 6 is formed as a continuous bore. The locking spring 7 is pretensioned and presses the two locking pistons 8 and 9 apart. The locking piston 8 engages in a locking receiver 10 provided for this, and the locking piston 9 engages in a locking receiver 11 provided for this. The locking mechanism 5 is formed rotationally symmetrical.

The locking pistons 8 and 9 have a uniform outer diameter 12 which remains constant over the entire axial length of the locking pistons 8 and 9. The outer diameter 12 is adapted to the inner diameter of the locking bore 6, whereby each locking piston 8, 9 is guided in the locking bore 6. Each locking piston 8, 9 has a blind bore in which the locking spring 7 is arranged so that this is guided over the inner diameter of the locking pistons 8, 9 and held coaxial to the locking pistons 8, 9. The ends 13, 14 of the blind bores are in contact with the respective end of the locking spring 7. The axial depth of the blind bore advantageously creates a large construction space for the locking spring 7. The locking pistons 8 and 9 are formed identical.

When the locking piston 8 is in engagement with its locking receiver 10, the locking mechanism 5 blocks an angular position between the output element 3 and the drive element 2. The locking receiver 10 is formed as a largely circular recess in the side cover 15, wherein hydraulic fluid can be supplied to the locking receiver 10 via an oil groove 18 formed by the side cover 15. This angular position can advantageously be arranged either as "retarded", "advanced" or in-between. For example here the locking position is selected as "retarded". By the supply of hydraulic fluid to the locking receiver 10, the locking mechanism 5 is transformed from the locked to the unlocked state. The locking piston 8 here moves against the spring force of the locking spring 7 into the locking bore 6. When the end of the locking piston 8 facing the locking receiver 10 passes the opening of the locking bore 6, again a rotation can take place between drive element 2 and output element 3. The other locking piston 9 is supported on the face of the side cover 16. To transform the locking mechanism 5 from the unlocked to the locked state, no hydraulic fluid is present in the locking receiver 10. The locking spring 7 presses the locking piston 8 into the locking receiver 10.

Figure 1B:
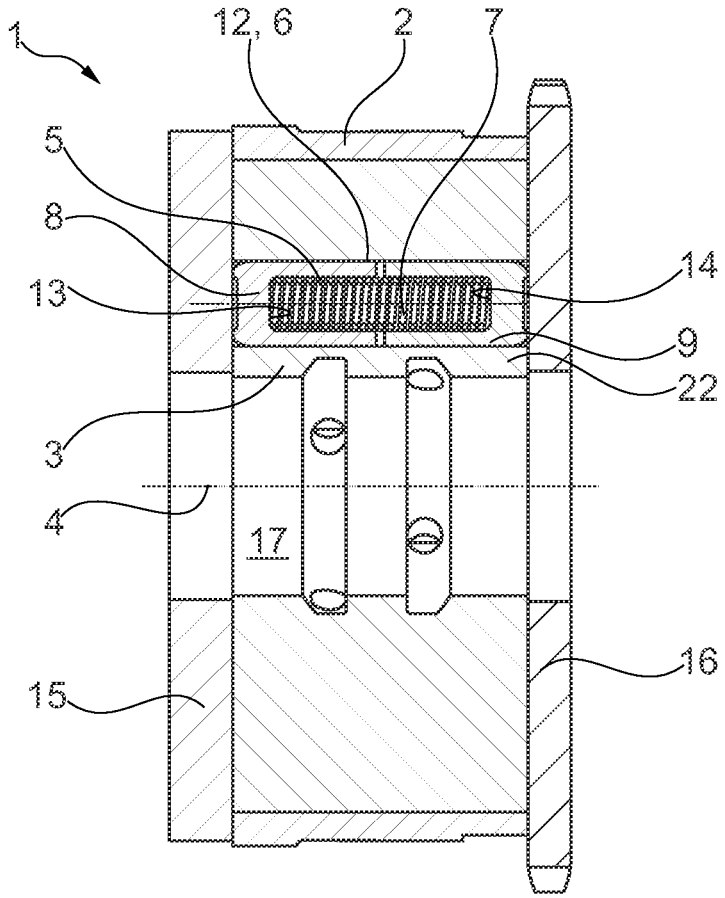
FIG. 1*b* shows a cross section according to FIG. 1*a* in a second angular position in which both locking pistons are lowered into the locking bore.

FIG. 1*b* shows a cross section according to FIG. 1*a* in a second angular position in which the two locking pistons 8 and 9 are lowered in the locking bore 6.

When both locking pistons 8 and 9 are lowered in the locking bore 6, a rotation is possible between drive element 2 and output element 3. Because the locking receivers 10 and 11 are formed as largely circular recesses, the locking pistons 8 and 9—as long as they are not opposite one of the locking receivers 10 and/or 11—are not exposed to hydraulic fluid. The end of the locking pistons 8, 9 facing the respective locking receiver 10, 11 is supported on the face of the respective side cover 15, 16 and does not prevent a rotation between drive element 2 and output element 3. In this unlocked state of the locking mechanism 5, the ends of the locking pistons 8 and 9 facing each other are spaced apart axially. The locking mechanism can provide a way in which the locking spring 7 does not go to block when the locking mechanism 5 is in unlocked state. A purging of the locking mechanism 5, in particular the spring chamber, can be provided.

Figure 1C:
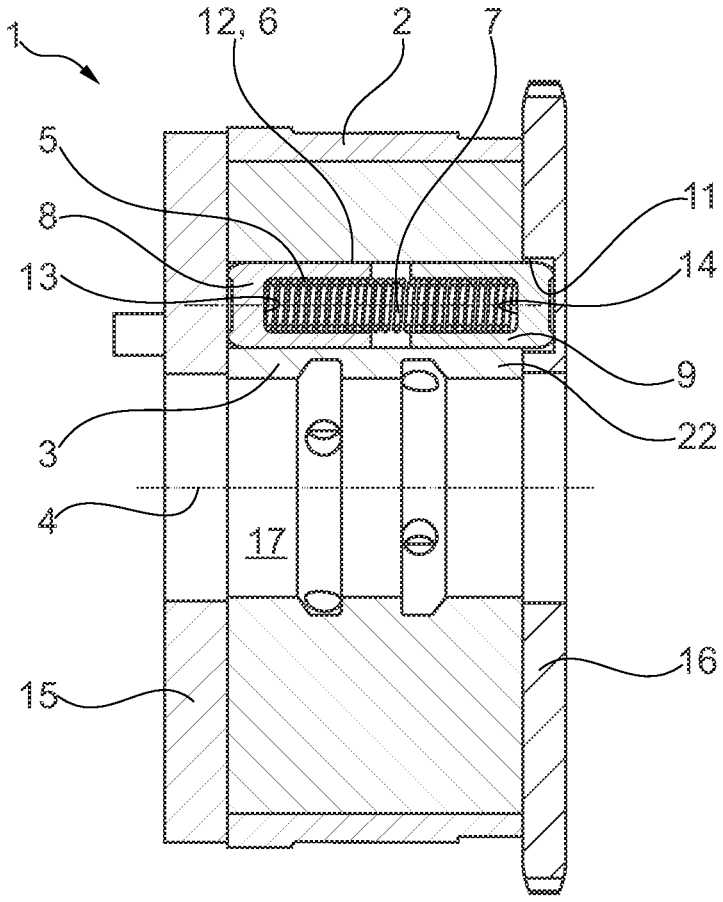
FIG. 1*c* shows the cross section according to FIG. 1*a* in a third angular position in which the second locking piston of the locking mechanism is locked in its locking receiver.

FIG. 1*c* shows the cross section according to FIG. 1*a* in a third angular position in which the second locking piston 9 of the locking mechanism 5 is locked in its locking receiver 11.

Now the locking piston 9 is in engagement with its locking receiver 11 and the locking mechanism 5 blocks an angular position between output element 3 and drive element 2. The locking receiver 11 is formed as a largely circular recess of the side cover 16, wherein hydraulic fluid can be supplied to the locking receiver 11 via an oil groove 19 formed by the side cover 16. This angular position can advantageously be arranged as either "retarded", "advanced" or in-between. For example here the angular position is selected as "advanced". The locking mechanism 5 is transformed from the locked to the unlocked state by a supply of hydraulic fluid to the locking receiver 11. The locking piston 9 here moves against the spring force of the locking spring 7 into the locking bore 6. When the end of the locking piston 9 facing the locking receiver 11 passes the opening of the locking bore 6, again a rotation can take place between drive element 2 and output element 3. The other locking piston 8 is now supported on the face of the side cover 15. To transform the locking mechanism 5 from the unlocked to the locked state, no hydraulic fluid is present in the locking receiver 11. The locking spring 7 presses the locking piston 9 into the locking receiver 11.

Figure 2:
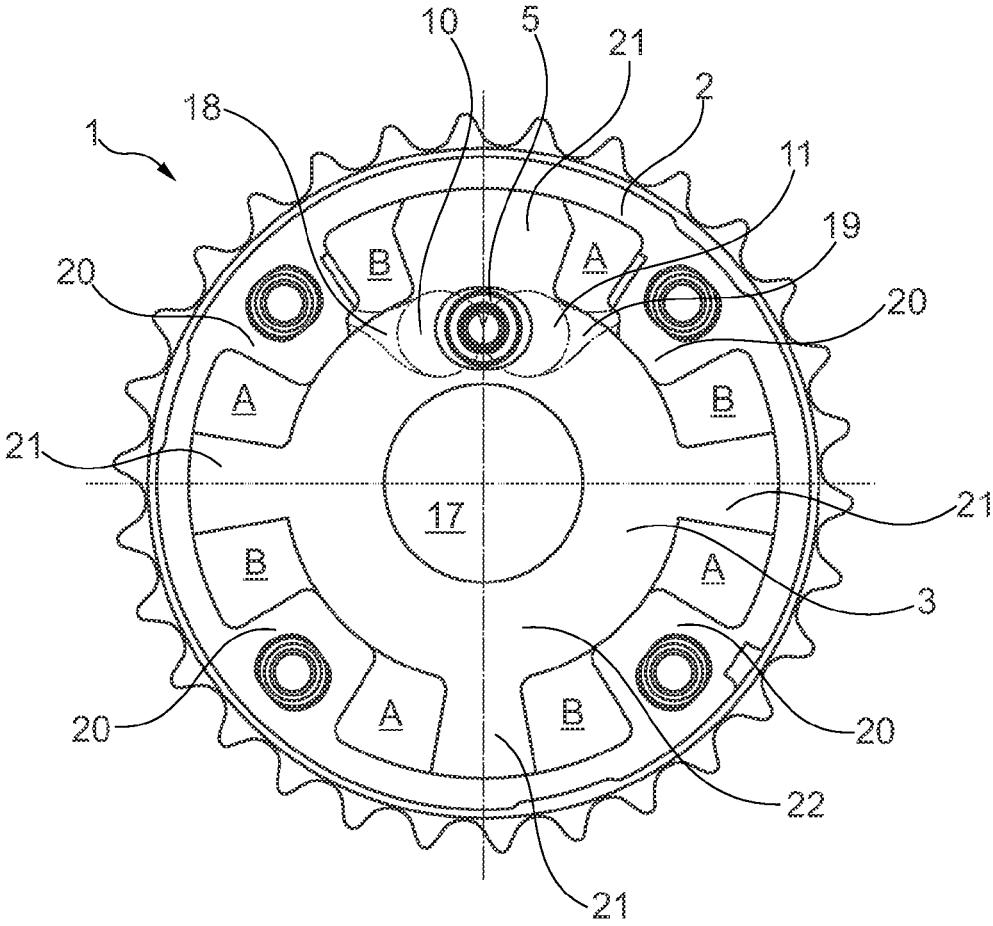
FIG. 2 shows a front view of the inside of a camshaft adjuster in the middle position between the drive element and the output element.

FIG. 2 shows a front view of the inside of the camshaft adjuster 1 in the middle position between drive element 2 and output element 3.

The vane 20 of the output element 3 is in the middle position i.e. the vane 20 has largely the same circumferential spacing from both flanking vanes 21 of the drive element 2. The drive element 2, like the output element 3, also has four vanes 21 which extend in the radial direction. As known from the prior art, the alternating arrangement of vanes 20 and 21 forms working chambers A and B which, with the insertion of hydraulic fluid, allow adjustment between drive element 2 and output element 3.

The oil groove 18 is connected fluid-conductively with the working chamber A, i.e. on filling of this working chamber A with hydraulic fluid, at the same time hydraulic fluid is supplied to the locking receiver 10 and the locking piston 8 can be moved into the locking bore 6. The locking mechanism 5 transforms into the unlocked state.

The oil groove 19 is connected fluid-conductively with working chamber B, i.e. on filling of this working chamber B with hydraulic fluid, at the same time hydraulic fluid is supplied to the locking receiver 11 and the locking piston 9 can be moved into the locking bore 6. The locking mechanism 5 transforms into the unlocked state.

In FIG. 2 the advantage of efficient use of construction space is clear. Again only one locking bore 6 is required to define, using the locking mechanism 5, two angular positions in which the rotation between drive element 2 and output element 3 can be blocked. Alternatively to this embodiment example, the locking receivers 10 and 11 can be arranged at the same angular position, whereby both locking pistons 8 and 9 simultaneously engage in this angular position and the locking mechanism 5 transforms into the locked state. Advantageously here a greater reliability of the locking function is achieved since at least one locking piston 8 or 9 engages to block an angular position. This angular position can be arranged in the "advanced", "retarded" or an intermediate position between "advanced" and "retarded", wherein ideally a middle position is provided as an intermediate position. By the arrangement of further locking receivers in addition to the locking receivers 10 and 11 on a side cover 15 and/or 16, further angular positions can be blocked with the locking mechanism 5 according to the invention.

LIST OF REFERENCE NUMERALS

1. Camshaft adjuster
2. Drive element
3. Output element
4. Rotational axis
5. Locking mechanism
6. Locking bore
7. Locking spring
8. Locking piston
9. Locking piston
10. Locking receiver
11. Locking receiver
12. Outer diameter
13. Support
14. Support
15. Side cover
16. Side cover
17. Central opening
18. Oil groove
19. Oil groove
20. Vane
21. Vane
22. Hub
A. Working chamber
B. Working chamber

The invention claimed is:

1. A camshaft adjuster comprising:

a drive element and an output element, the drive element is rotatable in relation to the output element within an angular range about a rotational axis of the camshaft adjuster, a locking mechanism is placed in a locking bore of the drive or the output element, the locking mechanism can assume a locked or an unlocked state in order to block or allow a rotation between the drive and output elements, the locking mechanism has precisely two locking pistons, defined as a first locking piston and a second locking piston, and at least one locking spring applies force simultaneously to the first and second locking pistons, a first locking receiver is associated with the first locking piston and a second locking receiver is associated with the second locking piston in order to fix an angular position between the drive and the output elements, a third locking receiver is provided which is spaced from the first or the second locking receiver in a circumferential direction and in which the first locking piston or the second locking piston can engage, and the locking receivers are arranged within the angular range and are formed in the other of the drive or the output element respectively which does not comprise the locking bore.

2. The camshaft adjuster as claimed in claim 1, wherein both of the first and second locking pistons with the associated first and second locking receivers fix precisely one angular position.

3. The camshaft adjuster as claimed in claim 1, wherein both of the locking pistons with the associated locking receivers fix two angular positions.

4. The camshaft adjuster as claimed in claim 1, wherein the angular position corresponds to an intermediate position between two extreme positions of the drive and the output elements.

5. The camshaft adjuster as claimed in claim 1, wherein the locking receivers are formed in the drive element and the locking bore is formed in the output element.

6. The camshaft adjuster as claimed in claim 1, wherein both of the locking pistons have a same outer diameter which is provided to guide the locking piston in the locking bore.

7. The camshaft adjuster as claimed in claim 6, wherein in the locked state of the locking mechanism, the outer diameter is in engagement with the locking receiver of the respective locking piston.

8. The camshaft adjuster as claimed in claim 7, wherein the locking piston comprises a support for the locking spring which is arranged axially inside the locking receiver when the locking mechanism is in the locked state.

9. The camshaft adjuster as claimed in claim 6, wherein the locking pistons are formed identical.

* * * * *